United States Patent [19]

Sakurai et al.

[11] Patent Number: 4,881,370

[45] Date of Patent: Nov. 21, 1989

[54] EXHAUST DEVICE FOR OUTBOARD MOTOR

[75] Inventors: Yoshihiro Sakurai; Yoshihide Fukuda; Kouji Abe, all of Hamamatsu, Japan

[73] Assignee: Sanshin Kogyo Kabushiki Kaisha, Hamamatsu, Japan

[21] Appl. No.: 151,524

[22] Filed: Feb. 2, 1988

[30] Foreign Application Priority Data

Feb. 10, 1987 [JP] Japan ..... 62-29223

[51] Int. Cl.[4] ..... F01N 7/12; B63H 21/26

[52] U.S. Cl. ..... 60/310; 440/53; 440/87; 440/89

[58] Field of Search ..... 60/310; 440/53, 87, 440/89

[56] References Cited

U.S. PATENT DOCUMENTS 3,127,866 4/1964 Mohr ..... 440/53
3,431,882 3/1969 Irgens ..... 440/89
3,961,595 6/1976 Meyer ..... 440/53
4,735,589 4/1988 Irwin ..... 440/87

FOREIGN PATENT DOCUMENTS 1062833 12/1953 France ..... 440/53

*Primary Examiner*—Douglas Hart
*Attorney, Agent, or Firm*—Ernest A. Beutler

[57] ABSTRACT

An improved exhaust system and bearing arrangement for a small displacement outboard motor that is rotatable through substantially 360 degrees for reverse operation. The drive shaft housing is formed with a reduced diameter cylindrical portion that is journaled within the swivel bracket by a bearing arrangement comprised of plastic elements and O-ring elements. The engine has an exhaust system with an exhaust pipe that at least in part encircles the drive shaft and which extends into the drive shaft housing below at least one the bearings to provide sufficient length for tuning and to avoid undue heating of the bearing.

25 Claims, 1 Drawing Sheet

EXHAUST DEVICE FOR OUTBOARD MOTOR

BACKGROUND OF THE INVENTION

This invention relates to an exhaust device for an outboard motor and more particularly to an improved exhaust and bearing arrangement for small displacement outboard motor.

The exists a class of small displacement outboard motors wherein the motor is supported for rotation through nearly 360 degrees about its steering axis so that the direction in which the propeller or propulsion device faces may be reversed for reversing the direction of travel of the watercraft. This type of outboard motor normally does not employ a forward, neutral, reverse transmission of the type utilized in larger displacement outboard motors. Although such an outboard motor construction has particularly advantage in that it is extremely simple and easy to operate, the full rotation of the outboard motor about its steering axis gives rise to certain difficulties.

In order to permit the outboard motor to be rotated through substantially 360 degrees, it has been the practice to provide a full bearing arrangement between the swivel bracket and the drive shaft housing of the outboard motor so that such rotation can be accomplished. However, such a bearing arrangement should be kept extremely compact so as to reduce the steering loads. As a result, the drive shaft housing of such outboard motors tends to neck down and be relatively small in diameter.

It is also the practice to discharge the exhaust gases from the engine to the atmosphere through the body of water in which the watercraft is operating. This is normally done by discharging the exhaust gases from the engine exhaust system into the drive shaft housing and then from the drive shaft housing into the body of water in which the watercraft is operating through an underwater high speed exhaust gas discharge. This means that the exhaust gases must flow through the restricted area of the drive shaft housing wherein the bearing support lies. This gives rise to two difficulties.

The first of these difficulties is that the exhaust pipe from the engine exhaust ports normally terminates in the drive shaft housing in an area above the area where the drive shaft housing is necked down for the bearing support. As a result, the length of the exhaust pipe is determined by the location of the necked down portion of the drive shaft housing and relatively short exhaust pipes must be employed. Such short exhaust pipes, however, do not provide the optimum tuning for maximum engine performance.

In addition, the discharge of the exhaust gases into the drive shaft housing at an area above the bearing support for the drive shaft housing can generate heat in the area of the bearings that can make steering movement difficult and which also might damage the bearings.

It is, therefore, a principal object of this invention to provide an improved exhaust system for a small displacement outboard motor.

It is another object of this invention to provide an exhaust system for an outboard motor of the type that rotates through substantially 360 degrees and wherein the length of the exhaust pipe may be extended from prior art constructions.

It is yet another object of the invention to provide an exhaust system for an outboard motor of the type that rotates through 360 degrees and wherein the exhaust gases will be delivered at an area where the bearing support for the outboard motor will not be heated.

As has been previously noted, outboard motors of this type provide a full 360 degree bearing between the drive shaft housing the swivel bracket. It is essential that such bearings be simple in construction and yet provide relatively low steering loads.

It is, therefore, a further object of this invention to provide an improved bearing arrangement for an outboard motor of this type.

SUMMARY OF THE INVENTION

This invention is adapted to be embodied in an outboard motor construction that is comprised of a swivel bracket that is adapted to be affixed to the transom of an associated watercraft. A power head contains an internal combustion engine having an output shaft. A drive shaft housing depends from the power head and contains a generally vertically extending drive shaft driven by the engine output shaft. Bearing means are interposed between the drive shaft housing and the swivel bracket for supporting the drive shaft housing for steering movement through substantially 360 degrees relative to the transom of the associated watercraft.

In accordance with a first feature of the invention, an exhaust pipe extends from the engine downwardly into the drive shaft housing to a position below the bearing means for discharging exhaust gases from the engine to the atmosphere through the drive shaft housing.

In accordance with another feature of the invention, an exhaust pipe extends from the engine into the drive shaft housing for discharging exhaust gases from the engine to the atmosphere through the drive shaft housing. The drive shaft passes at least in part through the exhaust pipe.

In accordance with yet another feature of the invention, the bearing means comprises an anti-friction element that is affixed to one of the swivel bracket and drive shaft housing and an O-ring element that is affixed relative to the other of the drive shaft housing and the swivel bracket. The anti-friction element is in direct bearing relationship with the O-ring element.

DETAILED DESCRIPTION OF THE PREFERRED EMBODIMENTS

Figure 1:
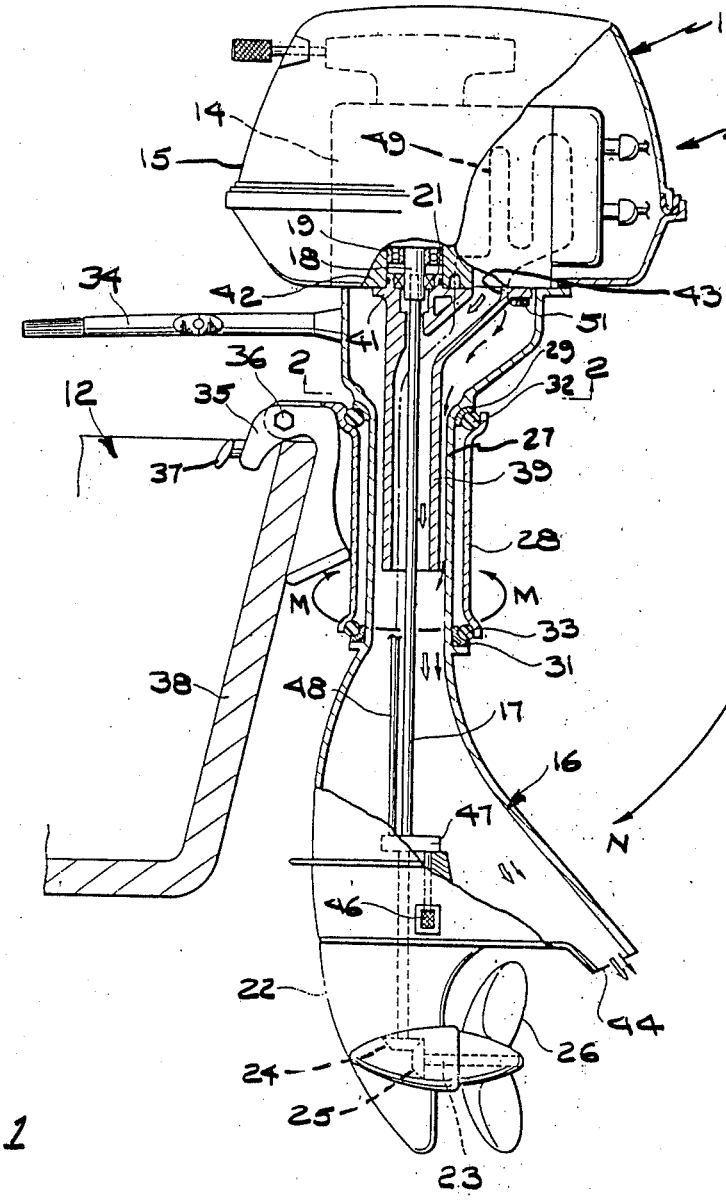
FIG. 1 is a side elevational view, with a portion broken away, of an outboard motor constructed in accordance with an embodiment of the invention.
Figure 2:
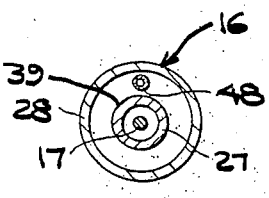
FIG. 2 is a cross-sectional view taken along the line 2—2 of FIG. 1.

The reference numeral 11 indicates generally an outboard motor of a small displacement type and which is constructed in accordance with an embodiment of the invention. The drawings illustrate the outboard motor 11 attached to a watercraft 12 which is depicted only partially and which is of any known type.

The outboard motor 11 is comprised of a power head assembly, indicated generally by the reference numeral 13, which consists of a powering internal combustion engine 14 and a surrounding protective cowling 15. The engine 14 may be of any known type but preferably is of a small displacement, two cylinder construction operating on a two-cycle principle with its crankshaft rotating about a generally vertically extending axis. As will be described, the engine 14 is water cooled and the source of cooling water for the engine 14 is derived from the body of water in which the watercraft 13 is operating.

A drive shaft housing, indicated generally by the reference numeral 16, depends from the power head 13 and contains a drive shaft 17 that is rotatably coupled to the engine output shaft by means of a coupling member 18. It should be noted that the coupling member 18 is journaled within a recess of the lower face of the engine 14 by means of an anti-friction bearing 19. An oil seal 21 is provided around the lower end of the coupling member 18 to prevent leakage.

The drive shaft housing 16 terminates at a lower unit 22 in which a propeller shaft 23 is contained. The drive shaft 17 extends into the lower unit 21 and has affixed to its lower end a bevel gear 24 that is in mesh with a bevel gear 25 carried by the propeller shaft 22 for driving the propeller shaft from the drive shaft 17. A propeller 26 is affixed to the outer end of the propeller shaft 22 for powering the watercraft 12 through the body of water in which the watercraft is operating.

Since the lower unit 22 is not provided with a forward, neutral, reverse transmission, an arrangement is incorporated for supporting the outboard motor 11 for steering movement through a full 360 degrees. To this end, the drive shaft housing 16 is provided with a reduced diameter, cylindrical portion 27 that is contained within and journaled by a swivel bracket assembly 28 for rotation through 360 degrees.

This journaling mechanism is comprised of a pair of oppositely facing generally arcuate bearing members 29 and 31 that are affixed to the upper and lower portions of the cylindrical drive shaft housing portion 27 in a known manner. The bearing elements 29 and 31 are conveniently formed from nylon or some other molded plastic having a relatively low coefficient of friction. The bearing elements 29 and 31 are engaged with respective upper and lower O-ring members 32 and 33 that are affixed to outwardly extending flanges of the swivel bracket 28. The O-ring elements 32 and 33 are formed from a synthetic or rubber-like material that will afford vibration damping for the vertical movement of the outboard motor 11 and provide good bearing relationship with the bearing elements 29 and 31 so that there will be substantially no friction opposing rotation of the outboard motor 11 about the axis defined by the bearing elements 29 and 31, which axis generally extends vertically.

The tiller 34 is affixed to the drive shaft housing 16 above the cylindrical portion 27 for facilitating the steering of the outboard motor 11 about the axis defined by the bearing elements 29 and 31. This direction of rotation is indicated by the arrows M—M.

The swivel bracket 28 is connected to a clamping bracket assembly 35 by means of a horizontally extending tilt pivot pin 36. This pivotal connection permits tilting movement of the outboard motor 11 relative to the watercraft 12 in a direction indicated by the arrow N—N for trim adjustment of the propeller 26 and also so as to permit the outboard motor 11 to be tilted up to an out of the water position. The clamping bracket 35 carries a clamping device 37 for clamping the outboard motor 11 to a transom 38 of the watercraft 12 in a known manner.

The engine 14 is provided with an exhaust system by which the exhaust gases are discharged from the engine combustion chambers through the body of water in which the watercraft 12 is operating to the atmosphere. This exhaust system includes an exhaust pipe 39 that is provided with a flanged portion 41 that is affixed in a known manner to a lower wall 42 of the engine 14. The exhaust pipe has an inlet opening 43 that communicates with the exhaust ports of the engine 14. It should be noted that the inlet opening 43 is displaced rearwardly of the axis of rotation of the drive shaft 17 when the motor 11 is in its normal steered forward direction. It should also be noted that the drive shaft 17 extends generally centrally through the drive shaft housing cylindrical portion 27 and thus lies substantially on the steering axis of the outboard motor 11.

From the inlet opening 43, the exhaust pipe 39 extends forwardly and downwardly in surrounding relationship with the drive shaft 17. The exhaust pipe 39 has a discharge end which is positioned within the drive shaft housing cylindrical portion 17 but below the uppermost bearing 29. In this way, the exhaust gases will be discharged downwardly and away from this uppermost bearing 29 so as to avoid heating of it and the O-ring 29. In addition, this permits tuning of the length of the exhaust pipe 39 so as to provide optimum engine performance.

There is provided in the drive shaft housing 16 rearwardly of the propeller 26 an exhaust gas discharge opening 44 through which the exhaust gases may be discharged from the hollow interior of the drive shaft housing 16 into the body of water in which the watercraft is operating. As is well known, such underwater exhaust gas discharges provide effective silencing.

It should be noted that even though the drive shaft 17 extends through the exhaust pipe 39, the upper bearing 19 is effectively insulated from the exhaust gas heat by means of an air chamber 45 that is formed at the upper end of the exhaust pipe 39 in adjacent relation to the oil seal 1 so as to provide heat insulation.

In the illustrated embodiment, the exhaust pipe 39 surrounds the drive shaft 17 and extends a substantial distance down into the drive shaft housing cylindrical portion 27. It may be understood that the exhaust pipe 39 need not encircle the drive shaft 17 but may, if desired for exhaust tuning, extend into the drive shaft housing cylindrical portion 27. Such an arrangement is feasible but does not provide as compact an assembly as that illustrated.

As been previously noted, the engine 14 is water cooled. To this end, there is provided an underwater cooling system inlet 46 in the lower part of the drive shaft housing 16 through which cooling water from the body of water in which the watercraft is operating may be drawn by a drive shaft driven cooling pump 47. The cooling pump 47 is positioned within the lower portion of the drive shaft housing 16 and is driven by the drive shaft 17 in a known manner. Pressurized water is transferred upwardly to the engine 14 through a generally vertically extending water conduit 48 which communicates at its upper end with the engine cooling system, as indicated schematically by the broken line 49.

Coolant that is discharged from the engine cooling jacket 49 flows downwardly into the drive shaft housing 16 through a coolant discharge 47 that extends in part through the upper end of the exhaust pipe 49. It should be noted that the solid arrows in FIG. 1 that this coolant is discharged into proximity with the uppermost bearing element 29 and also around the exhaust pipe 39 so as to cool it and the drive shaft housing cylindrical portion 27. As a result, the lower bearing 31 will also be effectively protected from the exhaust gas heat.

The coolant is returned to the body of water in which the watercraft is operating through the exhaust gas discharge 44.

It should be readily apparent from the foregoing description that there is provided an extremely compact yet highly effective exhaust system and bearing arrangement for a small displacement outboard motor. Although an embodiment of the invention has been illustrated and another embodiment described, various other changes and modifications may be made without departing from the spirit and scope of the invention, as defined by the appended claims.

We claim:

1. An outboard motor construction comprised of a swivel bracket to be affixed to the transom of an associated watercraft, a power head containing an internal combustion engine having an output shaft, a drive shaft housing depending from said power head and containing a generally vertically extending drive shaft driven by said engine output shaft, a lower unit affixed to the lower end of said drive shaft housing and carrying propulsion means and means for driving said propulsion means from the lower end of said drive shaft, bearing means between said drive shaft housing and said swivel bracket for supporting said drive shaft housing for steering movement through substantially 360 degrees relative the transom of the associated watercraft, and an exhaust pipe affixed at its upper end to said engine and extending from said engine downwardly into said drive shaft housing and terminating at a position therein below said bearing means and above said lower unit for discharging exhaust gases from said engine to the atmosphere through said drive shaft housing, the lower end of said exhaust pipe being out of heat exchanging relationship with said drive shaft housing by being spaced therefrom for precluding the transfer of heat from said exhaust gases to said bearing means.

2. An outboard motor construction as set forth in claim 1 wherein the engine is water cooled from the water in which the outboard motor is operating.

3. An outboard motor construction comprised of a swivel bracket adapted to be affixed to the transom of an associated watercraft, a power head containing a water cooled internal combustion engine cooled by the water in which said outboard motor operates, said internal combustion engine having an output shaft, a drive shaft housing depending from said power head and containing a generally vertically extending drive shaft drive by said engine output shaft, bearing means between said drive shaft housing and said swivel bracket for supporting said drive shaft housing for steering movement through substantially 360 degrees relative to the transom of the associated watercraft, an exhaust pipe extending from said engine downwardly into said drive shaft housing to a position below said bearing means for discharging exhaust gases from said engine to the atmosphere through said drive shaft housing, and means for discharging cooling water from the engine back to the body of water in which the water watercraft is operating through said drive shaft housing, the cooling water being delivered to said drive shaft housing above said bearing means for cooling said bearing means.

4. An outboard motor construction as set forth in claim 2 wherein the cooling water from the engine cooling system is discharged back to the body of water in which the watercraft is operating through the drive shaft housing, the cooling water being delivered to the drive shaft housing in proximity to the exhaust pipe for cooling the exhaust pipe.

5. An outboard motor construction as set forth in claim 4 wherein the cooling water is delivered to the drive shaft housing above the bearing means for cooling the bearing means in addition to the exhaust pipe.

6. An outboard motor construction as set forth in claim 5 wherein the bearing means comprises an anti-friction element supported by one of the swivel bracket and drive shaft housing and an O-ring element affixed relative to the other of the drive shaft housing and the swivel bracket and engaged with the anti-friction element.

7. An outboard motor construction as set forth in claim 6 wherein the bearing means comprises a pair of spaced apart bearings comprised of anti-friction elements and O-ring elements as described.

8. An outboard motor construction as set forth in claim 7 wherein the exhaust gases are delivered from the exhaust pipe to the drive shaft housing below only the uppermost bearing means.

9. An outboard motor construction as set forth in claim 1 wherein the exhaust pipe at least in part surrounds the drive shaft.

10. An outboard motor construction comprised of a swivel bracket adapted to be affixed to the transom of an associated watercraft, a power head containing a water cooled internal combustion engine cooled by the water in which said outboard motor operates, said internal combustion engine having an output shaft, a drive shaft housing depending from said power head and containing a generally vertically extending drive shaft driven by said engine output shaft, axially spaced apart bearing means between said drive shaft housing and said swivel bracket for supporting said drive shaft housing for steering movement through substantially 360 degrees relative to the transom of the associated watercraft, an exhaust pipe extending from said engine downwardly into said drive shaft housing to a position below said bearing means for discharging exhaust gases from said engine to the atmosphere through said drive shaft housing, and means for discharging, said exhaust pipe at least in part surrounding said drive shaft, and means for providing heat insulation between said exhaust pipe and the uppermost bearing of the drive shaft.

11. An outboard motor construction as set forth in claim 10 wherein the engine is water cooled from the water in which the outboard motor is operating.

12. An outboard motor construction as set forth in claim 11 wherein the cooling water from the engine is discharged back to the body of water in which the the watercraft is operating through the drive shaft housing, the cooling water being delivered to the drive shaft housing above the bearing means for cooling the bearing means.

13. An outboard motor construction as set forth in claim 11 wherein the cooling water from the engine cooling system is discharged back to the body of water in which the watercraft is operating through the drive shaft housing, the cooling water being delivered to the drive shaft housing in proximity to the exhaust pipe for cooling the exhaust pipe.

14. An outboard motor construction as set forth in claim 13 wherein the cooling water is delivered to the drive shaft housing above the bearing means for cooling the bearing means in addition to the exhaust pipe.

15. An outboard motor construction comprised of a swivel bracket adapted to be affixed to the transom of an associated watercraft, a power head containing an internal combustion engine having an output shaft, a drive shaft housing depending from said power head and containing a generally vertically extending drive shaft driven by said engine output shaft, bearing means between said drive shaft housing and said swivel bracket for supporting said drive shaft housing for steering movement through substantially 360 degrees relative the transom of the associated watercraft, and an exhaust pipe extending from said engine into said drive shaft housing and terminating between the upper and lower ends thereof for discharging exhaust gases from said engine through a selected length exhaust pipe to the atmosphere through said drive shaft housing, said drive shaft passing at least in part through said exhaust pipe.

16. An outboard motor construction as set forth in claim 15 wherein the exhaust pipe is affixed at its inlet end to a lower face of the engine.

17. An outboard motor construction as set forth in claim 16 further including means for providing heat insulation between the exhaust pipe and the uppermost bearing of the drive shaft.

18. An outboard motor construction as set forth in claim 17 wherein the means for insulating the uppermost bearing of the drive shaft comprises an air gap defined around the drive shaft and between the exhaust pipe and the drive shaft.

19. An outboard motor construction as set forth in claim 18 wherein the engine is water cooled from the water in which the outboard motor is operating.

20. An outboard motor construction as set forth in claim 19 wherein the cooling water from the engine cooling system is discharged back to the body of water in which the watercraft is operating through the drive shaft housing, the cooling water being delivered to the drive shaft housing in proximity to the exhaust pipe for cooling the exhaust pipe.

21. An outboard motor construction comprised of a swivel bracket adapted to be affixed to the transom of an associated watercraft, a power head containing an internal combustion engine having an output shaft, a drive shaft housing depending from said power head and containing a generally vertically extending drive shaft driven by said engine output shaft, and bearing means between said drive shaft housing and said swivel bracket for supporting said drive shaft housing for steering movement through substantially 360 degrees relative the transom of the associated watercraft, said bearing means comprising an anti-friction element affixed to one of said swivel bracket and said drive shaft housing and an O-ring element affixed relative to the other of the drive shaft housing and the swivel bracket and engaged with the anti-friction element.

22. An outboard motor construction as set forth in claim 21 wherein the anti-friction element is a non-metallic element.

23. An outboard motor construction as set forth in claim 21 wherein there are spaced apart upper and lower bearing means each comprised of an anti-friction element and an O-ring element as described.

24. An outboard motor construction as set forth in claim 23 wherein the anti-friction elements are affixed to the drive shaft housing and the O-ring elements are affixed to the swivel bracket.

25. An outboard motor construction as set forth in claim 24 wherein the anti-friction element is a non-metallic element.

* * * * *